US010858182B2

(12) United States Patent
Moffatt

(10) Patent No.: US 10,858,182 B2
(45) Date of Patent: Dec. 8, 2020

(54) AUTOMATIC LOCKING TRASHCAN SYSTEM AND METHOD

(71) Applicant: Matthew Moffatt, Burlington (CA)

(72) Inventor: Matthew Moffatt, Burlington (CA)

( * ) Notice: Subject to any disclaimer, the term of this patent is extended or adjusted under 35 U.S.C. 154(b) by 0 days.

(21) Appl. No.: 16/195,788

(22) Filed: Nov. 19, 2018

(65) Prior Publication Data

US 2020/0140195 A1 May 7, 2020

(30) Foreign Application Priority Data

Nov. 7, 2018 (CA) ..... 3023327

(51) Int. Cl.
*B65F 1/14* (2006.01)
*B65F 1/16* (2006.01)
*B65F 1/08* (2006.01)

(52) U.S. Cl.
CPC ..... *B65F 1/1615* (2013.01); *B65F 1/08* (2013.01); *B65F 1/163* (2013.01); *B65F 2210/148* (2013.01)

(58) Field of Classification Search
CPC .. B65D 2251/1058; B65F 1/1615; B65F 1/08; B65F 1/163; B65F 2210/144; B65F 2210/148; Y10S 220/908; Y10S 295/04
USPC ..... 220/495.06, 908, 263; 292/130, 230
See application file for complete search history.

(56) References Cited

U.S. PATENT DOCUMENTS

2003/0168466 A1* 9/2003 Spiers ..... B65F 1/1615 220/835
2003/0189340 A1* 10/2003 Kitzis ..... E05C 19/184 292/145
2006/0016816 A1* 1/2006 Bremer ..... B65F 1/1615 220/322
2007/0029819 A1* 2/2007 Kitzis ..... B65F 1/1615 292/304
2014/0238990 A1* 8/2014 Banik ..... B65F 1/1615 220/324
2014/0299602 A1* 10/2014 Manssourian ..... B65F 1/1615 220/315
2015/0053684 A1* 2/2015 Nussbaum ..... E05B 15/0093 220/324
2016/0159570 A1* 6/2016 Reeb ..... B65F 1/1615 220/324

* cited by examiner

*Primary Examiner* — Fenn C Mathew
*Assistant Examiner* — Elizabeth J Volz
(74) *Attorney, Agent, or Firm* — David W Barman

(57) ABSTRACT

An automatic locking trashcan system including: a trashcan assembly having a trashcan-body having an inner volume; and an outer-surface; a trashcan-lid; and an automatic-locking-assembly; wherein the trashcan assembly includes the trashcan-body, the trashcan-lid and the automatic-locking-assembly in functional combination such that when the trashcan-body is not normal to a ground surface the automatic-locking-assembly secures the trashcan-lid to the trashcan-body such that trashcan-contents are not able to leave the inner volume. Structurally speaking, the trashcan-body is defined by the inner volume and the outer-surface.

18 Claims, 5 Drawing Sheets

AUTOMATIC LOCKING TRASHCAN SYSTEM AND METHOD

BACKGROUND OF THE INVENTION

This application claims benefit under 35 USC 119 to Canada National Application No. 3,023,327 filed on Nov. 7, 2018, the disclosure of which is incorporated herein by reference in its entirety. The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of cabinet structures of existing art and more specifically relates to an automatic locking trashcan.

RELATED ART

People who live and work in households and residential properties generate trash. Trash/refuse is typically kept in trashcans and then delivered to the curb for pickup by garbage trucks that deliver the garbage in bulk to the landfills. Many times wind storms and the like can topple trashcans which makes for a mess that needs to be cleaned up. A suitable solution is desired.

Foreign Pat. No. EP0699600 to Beckmannshagen et al., relates to a lockable refuge container. The described lockable refuge container includes a locking device which is automatically unlocked when it is tipped into the position of being emptied by a bolt rod (18) which is spring tensioned (21) into its closing position. The bolt rod is displaceable parallel to the lid and in the closed position engages in a closing hook attached to the vertical wall of the bin. A weight (15) is set Rotationally movable in the lid whereby the bolt rod and weight are coupled together to convert the rotary movement of the weight into a longitudinal displacement of the bolt rodwill automatically release the lock. The bolt rod has a protruding journal (23) and the weight has an inclined plane (24) running down on the journal as the weight rotates. The bolt rod can have on angled arm to produce a vertical distance between the lid and closing hook.

SUMMARY OF THE INVENTION

In view of the foregoing disadvantages inherent in the known supports: cabinet structure art, the present disclosure provides a novel automatic locking trashcan. The general purpose of the present disclosure, which will be described subsequently in greater detail, is to provide an efficient and effective automatic locking trashcan to minimize mess and prevent safety issues.

An automatic locking trashcan system is disclosed herein comprising: a trashcan assembly comprising a trashcan-body having an inner volume; and an outer-surface; a rigid inner liner; a trashcan-lid; and an automatic-locking-assembly (including a spring arm hook; a latch-arm; a pivot pin, a top guide bracket, a spring bracket, a spring pin, and a bottom guide bracket); and a step on pedal; wherein the trashcan assembly comprises the trashcan-body, the trashcan-lid and the automatic-locking-assembly in functional combination such that when the trashcan-body is not normal to a ground surface the automatic-locking-assembly secures the trashcan-lid to the trashcan-body such that trashcan-contents are not able to leave the inner volume. Structurally speaking, the trashcan-body is defined by the inner volume and the outer-surface. The automatic-locking-assembly comprises in functional combination the a spring arm hook; a latch-arm; a pivot pin, a top guide bracket, a spring bracket, a spring pin, and a bottom guide bracket and in alternate embodiments a latch-bar, the hook, the rod, and the spring. As designed the automatic-locking-assembly is able to alternate between an unlocked-condition and a locked-condition dependent on a relative orientation of the trashcan-body to the ground surface.

A method of use for the automatic locking trashcan system is also disclosed herein, the method comprising the steps of: providing the automatic locking trashcan system disclosed; opening the trashcan-lid relative to the trashcan-body; filling refuse in the inner volume; and closing the trashcan-lid relative to the trashcan-body; wherein when the trashcan-body is not normal to a ground surface the automatic-locking-assembly secures the trashcan-lid to the trashcan-body such that trashcan-contents of the refuse are not able to leave confines of the inner volume.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an automatic locking trashcan, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to cabinet structures and more particularly to an automatic locking trashcan as used to provide that the contents of the trashcan remain within its confines when tipped over.

Generally, the present invention comprises a trashcan that automatically locks the lid when the trashcan is tipped over to keep all the trash contents inside. When the trashcan is upright it remains unlocked. This keeps the surrounding area clean of refuse, keeps pets and children safe from exposed garbage and refuse secured within the trashcan inner volume. The device is designed for ease of use and to be fail-safe.

Referring now more specifically to the drawings by numerals of reference, there is shown in FIGS. 1-4, various views of an automatic locking trashcan system 100.

Figure 1:
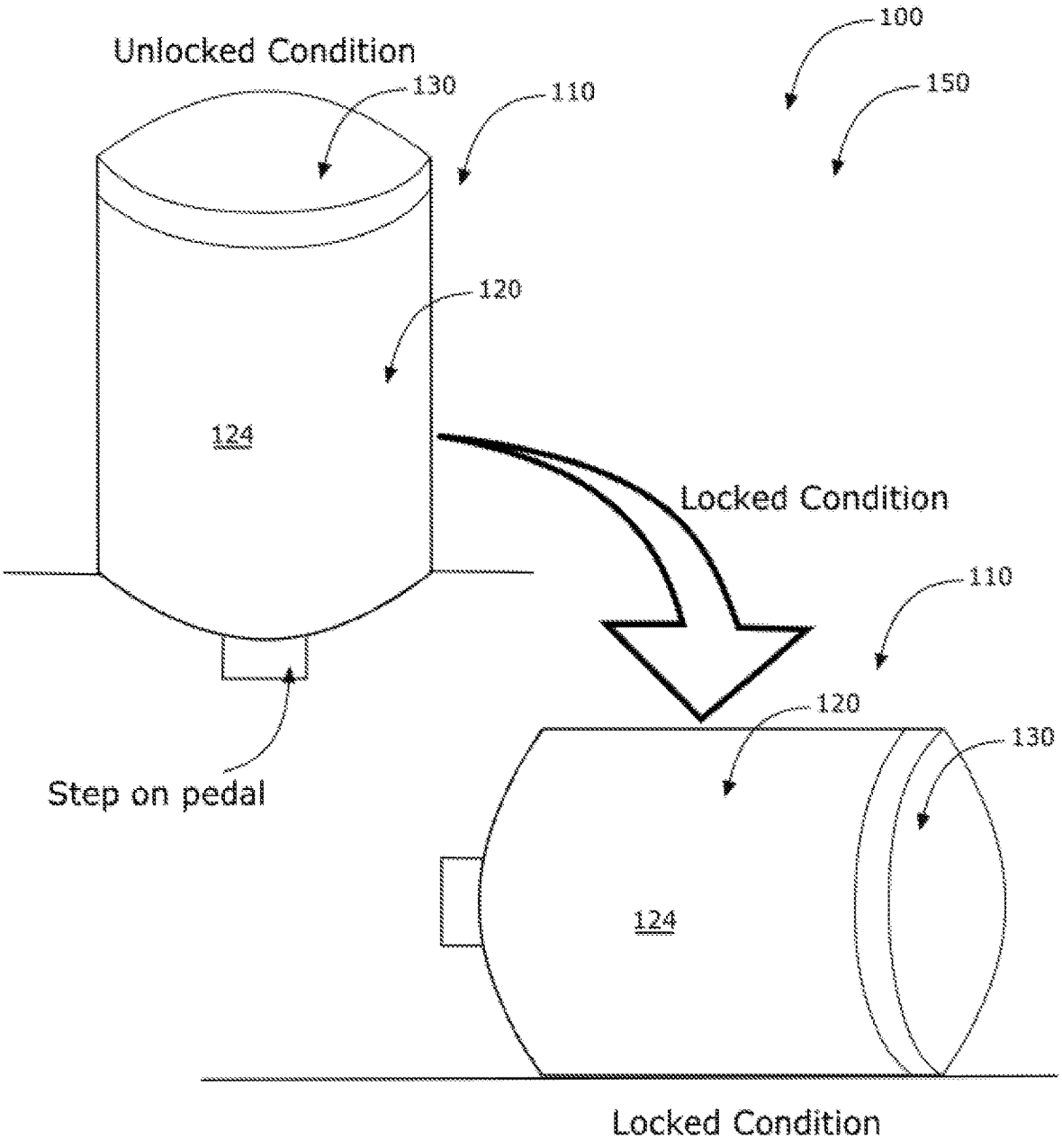
FIG. 1 is a perspective view of the automatic locking trashcan during an 'in-use' condition (going from an unlocked condition to a locked condition, as the trashcan is being tipped), according to an embodiment of the disclosure.

FIG. 1 shows an automatic locking trashcan system 100 during an 'in-use' condition 150, according to an embodiment of the present disclosure. Here, the automatic locking trashcan system 100 may be beneficial for use by a user to prevent unnecessary spillage of refuse due to trashcans tipping over. As illustrated, the automatic locking trashcan system 100 may include trashcan assembly 110 comprising a trashcan-body 120 having an inner volume 122; and an outer-surface 124; a trashcan-lid 130; and an automatic-locking-assembly 140 comprising a spring arm hook; a latch-arm; a pivot pin, a top guide bracket, a spring bracket, a spring pin, and a bottom guide bracket (alternate embodiments may include a latch-bar 142; a hook 144; a rod 146; and a spring 148); wherein the trashcan assembly 110 comprises the trashcan-body 120, the trashcan-lid 130 and the automatic-locking-assembly 140 in functional combination such that when the trashcan-body 120 is not normal (vertical) to a ground surface (FIG. 3) the automatic-locking-assembly 140 secures the trashcan-lid 130 to the trashcan-body 120 such that trashcan-contents (refuse; garbage) are not able to leave the inner volume 122. Relationally speaking, the trashcan-body 120 is defined by the inner volume 122 and the outer-surface 124. The automatic-locking-assembly 140 comprises in functional combination the latch-bar 142, the hook 144, the rod 146, and the spring 148. As designed, the automatic-locking-assembly 140 is able to alternate between an unlocked-condition and a locked-condition dependent on a relative orientation of the trashcan-body 120 to the ground surface, as shown in FIGS. 1 and 4.

According to one embodiment, the automatic locking trashcan system 100 may be arranged as a kit. In particular, the automatic locking trashcan system 100 may further include a set of instructions. The instructions may detail functional relationships in relation to the structure of the automatic locking trashcan system 100 such that the automatic locking trashcan system 100 can be used, maintained, or the like, in a preferred manner.

Figure 2:
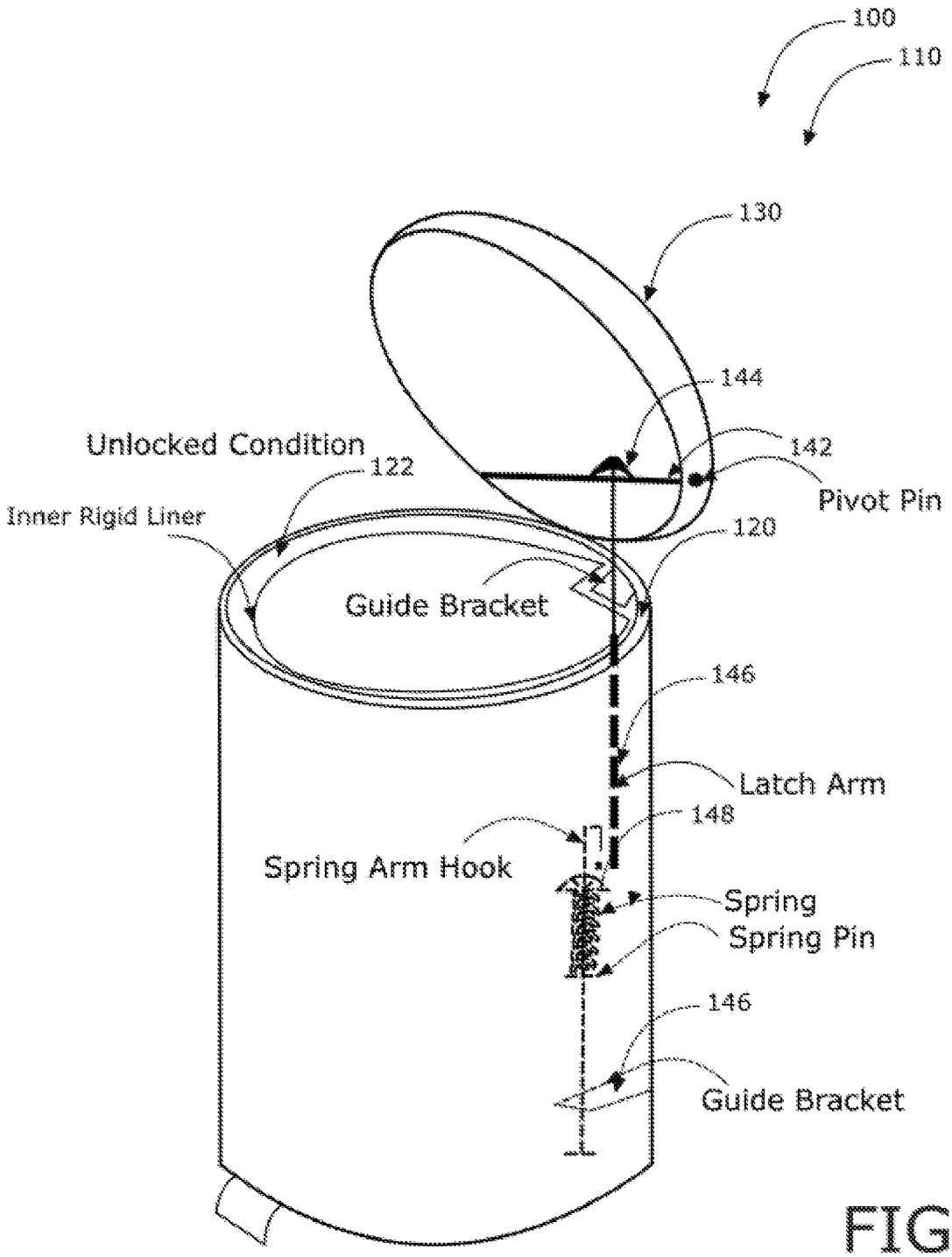
FIG. 2 is a perspective view of the automatic locking trashcan of FIG. 1, in an unlocked condition, according to an embodiment of the present disclosure.
Figure 3:
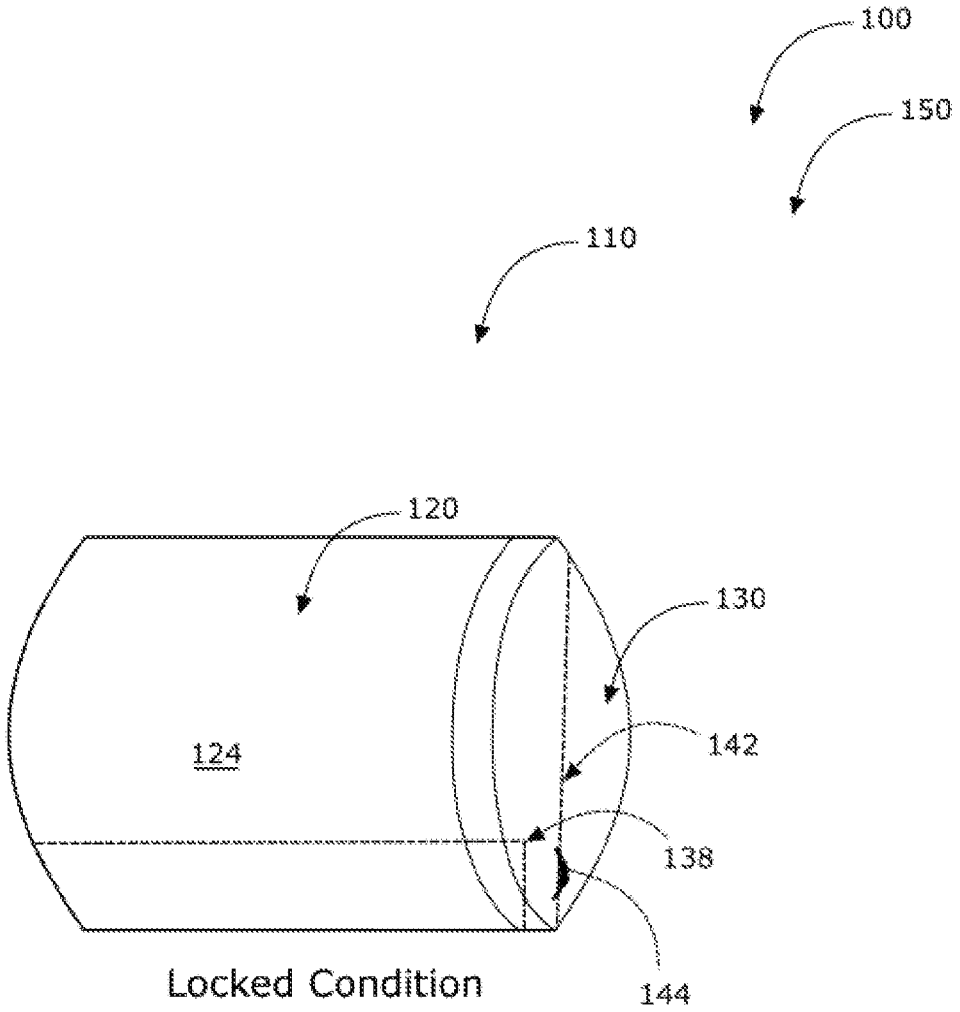
FIG. 3 is a perspective view of the automatic locking trashcan of FIG. 1, in a locked condition, according to an embodiment of the present disclosure.
Figure 4:
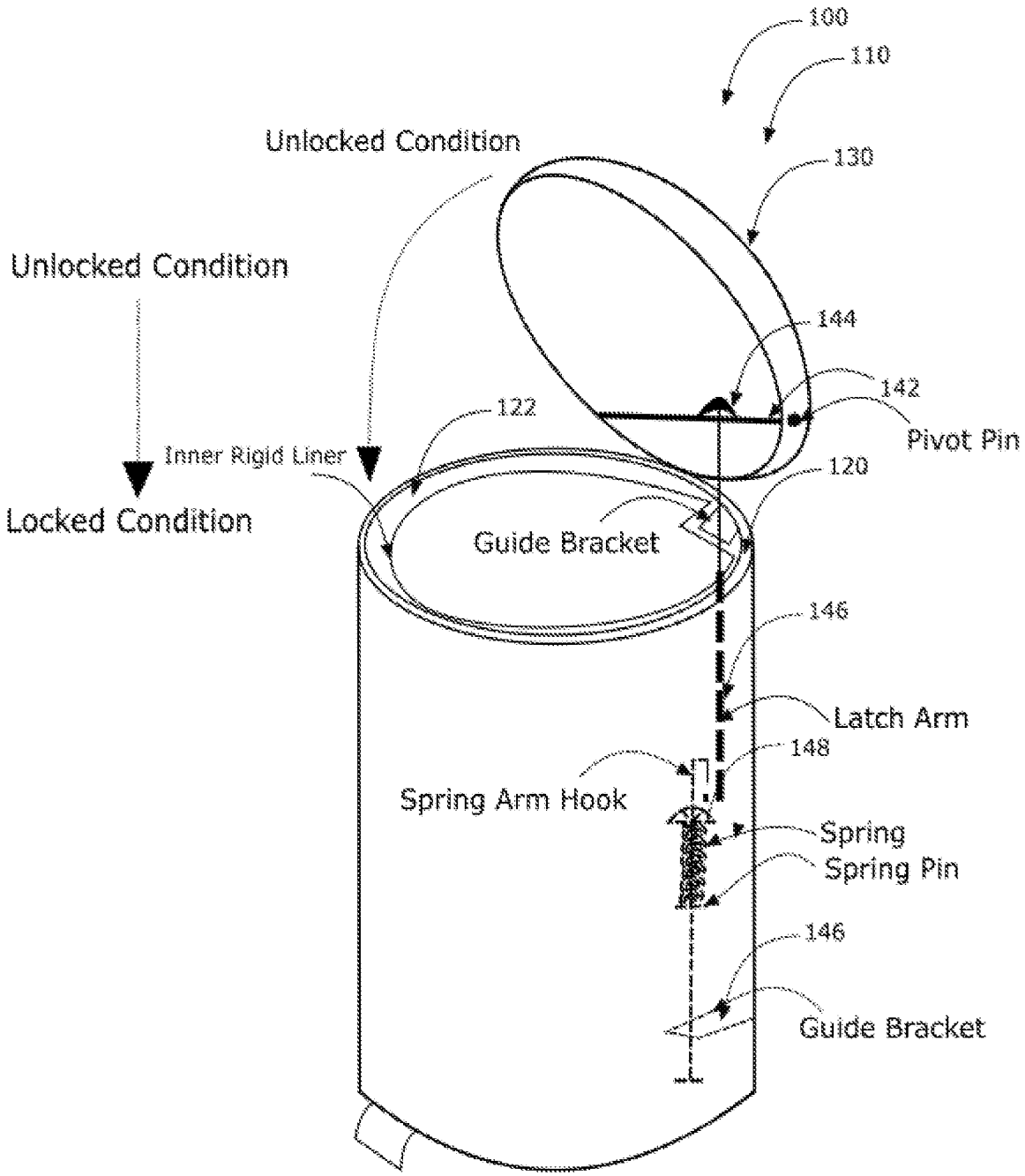
FIG. 4 is a perspective view of the automatic locking trashcan of FIG. 1, going from an unlocked condition to a locked condition, according to an embodiment of the present disclosure.

Referring now to FIGS. 2-4 showing various views of the automatic locking trashcan system 100 of FIG. 1, according to an embodiment of the present disclosure.

The automatic-locking-assembly 140 is located with the inner volume 122 of the trashcan-body 120; wherein the trashcan-lid 130 and the trashcan-body 120 are normally in the unlocked-condition when the trashcan-body 120 is normal to the ground surface (FIG. 2). The unlocked-condition permits the trashcan-lid 130 to rotate in relation to the trashcan-body 120. The locked-condition does not permit the trashcan-lid 130 to rotate in relation to the trashcan-body 120 (FIG. 3).

Referring now to alternate embodiments of the automatic-locking-assembly 140; the latch-bar 142 is mounted horizontally within the trashcan-lid 130. The hook 144 is engaged to the latch-bar 142 when the trashcan-body 120 is not normal to the ground surface (FIG. 3); wherein the hook 144 is coupled in series to the rod 146. The spring 148 is in mechanical communication with the rod 146; wherein the spring 148 locks the rod 146 in statis when the trashcan-body 120 is not normal (tipped over or the like) to the ground surface (FIG. 3). The spring 148 locking the rod 146 causes the hook 144 to engage the latch-bar 142 to retain the trashcan-lid 130 in coupled communication with the trashcan-body 120. The coupled communication between the trashcan-lid 130 and the trashcan-body 120 is adjacent each other so long as the trashcan-body 120 is not normal to the ground surface. The latch-bar is preferably located nearest a rear-inside of the trashcan-lid 130. The trashcan assembly 110 further comprises a rear-housing 138 to substantially contain components of the automatic-locking-assembly 140 such that refuse does not contact the automatic-locking-assembly 140 so as to impede proper usage. The trashcan-body 120 when not normal to the ground surface causes the spring 148 to pull the rod 146 in compression. The trashcan-body 120 when normal to the ground surface (FIG. 2) does not cause the spring 148 to pull the rod 146 in compression. It should be understood that various means such as electric sensors and mechanical means and the like for manipulating the lock may be employed so as to indicate when a tipping action is occurring/has occurred.

In preferred embodiments the latch arm is mounted horizontally within the trash can and attached to the pivot pin in the trash can lid. The spring arm hook is threaded through the spring and the spring is mounted to the spring bracket. The spring bracket is mounted to the trash can body. The top guide is mounted to the trash can body and the latch arm runs through the guide slot. The bottom guide is mounted to the trash can body and the spring arm hook runs through the guide slot. When the trash can is upright the spring arm protruding out the bottom has pressure applied to it by the floor leaving the can unlocked. As soon as the pressure is removed (tips over) the spring creates a downward pressure pulling the spring arm hook down latching to the latch arm and pulling down the lid and locking it into place.

Figure 5:
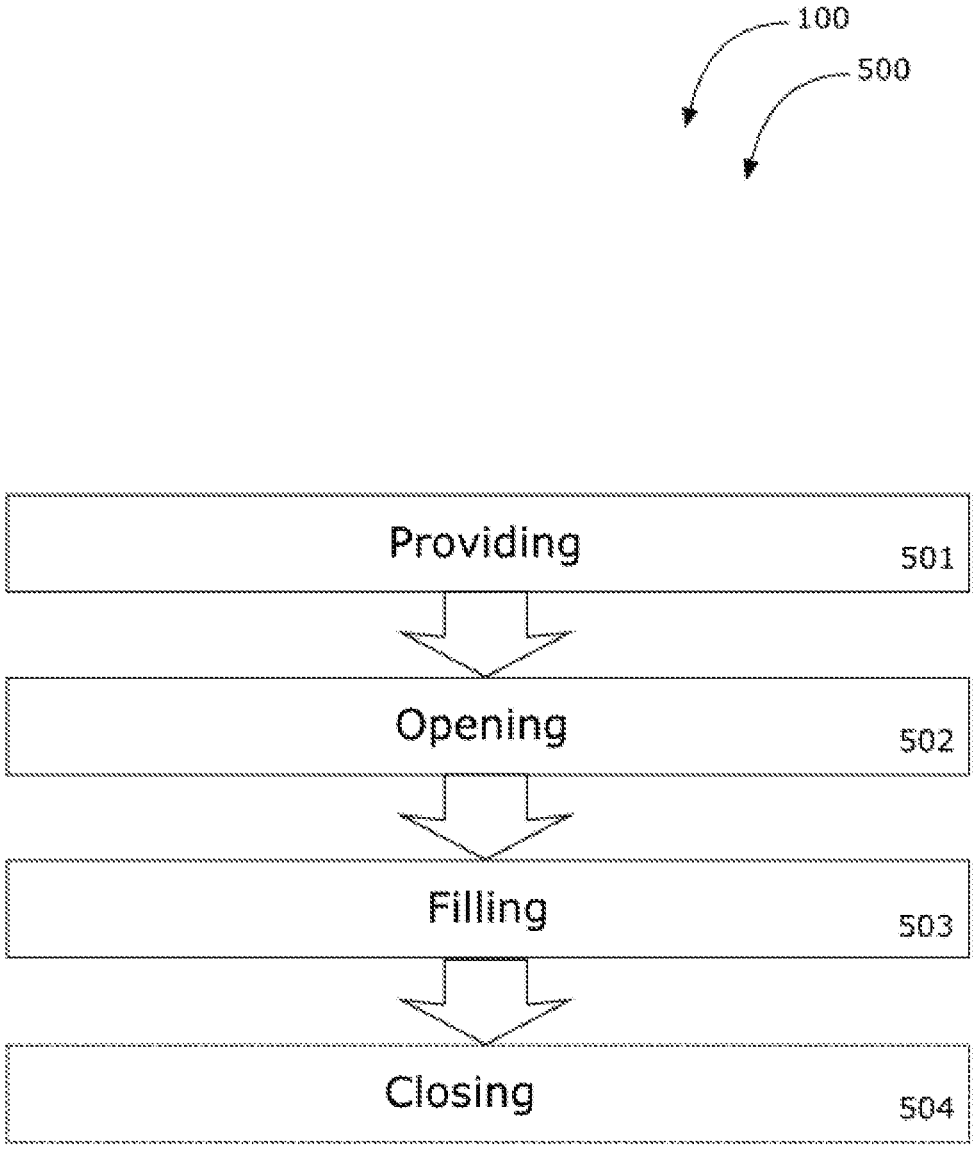
FIG. 5 is a flow diagram illustrating a method of use for the automatic locking trashcan, according to an embodiment of the present disclosure.

Referring now to FIG. 5 showing a flow diagram illustrating a method of use 500 for automatic locking trashcan system 100, according to an embodiment of the present disclosure. In particular, the method of use 500 may include one or more components or features of the automatic locking trashcan system 100 as described above. As illustrated, the method of use 500 may include the steps of: step one 501, providing the automatic locking trashcan system disclosed; step two 502, opening the trashcan-lid relative to the trashcan-body; step three 503, filling refuse in the inner volume; step four 504, closing the trashcan-lid relative to the trashcan-body; wherein when the trashcan-body is not normal to a ground surface the automatic-locking-assembly secures the trashcan-lid to the trashcan-body such that trashcan-contents of the refuse are not able to leave confines of the inner volume (trash can is always closed unless step-on pedal isn't pressed down).

It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for trashcan containment means via locking are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An automatic locking trashcan system comprising:
a trashcan assembly comprising;
a trashcan-body having,
an inner volume; and
an outer-surface;
a trashcan-lid; and
an automatic-locking-assembly including,
a spring arm hook;
a latch-arm;
a pivot pin,
a top guide bracket,
a spring bracket,
a spring pin, and
a bottom guide bracket;
a step on pedal; and
a rigid inner liner;
wherein said trashcan assembly comprises said trashcan-body, said trashcan-lid and said automatic-locking-assembly in functional combination such that when said trashcan-body is not normal to a ground surface said automatic-locking-assembly secures said trashcan-lid to said trashcan-body such that trashcan-contents are not able to leave said inner volume;
wherein said trashcan-body is defined by said inner volume and said outer-surface; and
wherein said automatic-locking-assembly is able to alternate between an unlocked-condition and a locked-condition dependent on a relative orientation of said trashcan-body to said ground surface.

2. The automatic locking trashcan system of claim 1, wherein the automatic-locking-assembly is located within said inner volume of said trashcan-body.

3. The automatic locking trashcan system of claim 2, wherein said trashcan-lid and said trashcan-body are normally in said unlocked-condition when said trashcan-body is normal to said ground surface.

4. The automatic locking trashcan system of claim 3, wherein said unlocked-condition permits said trashcan-lid to rotate in relation to said trashcan-body.

5. The automatic locking trashcan system of claim 1, wherein said locked-condition does not permit said trashcan-lid to rotate in relation to said trashcan-body.

6. The automatic locking trashcan system of claim 5, further comprising a latch bar mounted horizontally within said trashcan-lid.

7. The automatic locking trashcan system of claim 6, wherein the hook is engaged to said latch-bar when said trashcan-body is not normal to said ground surface.

8. The automatic locking trashcan system of claim 7, wherein the hook is coupled in series to said latch arm.

9. The automatic locking trashcan system of claim 8, further comprising a spring in mechanical communication with said latch arm.

10. The automatic locking trashcan system of claim 9, wherein the spring locks said latch arm in statis when said trashcan-body is not normal to said ground surface.

11. The automatic locking trashcan system of claim 10, wherein the spring locking said latch arm causes said hook to engage said latch-bar to retain said trashcan-lid in coupled communication with said trashcan-body.

12. The automatic locking trashcan system of claim 11, wherein the coupled communication between said trashcan-lid and said trashcan-body is adjacent each other so long as the trashcan-body is not normal to said ground surface.

13. The automatic locking trashcan system of claim 12, wherein the latch-bar is located nearest a rear-inside of said trashcan-lid.

14. The automatic locking trashcan system of claim 13, wherein the trashcan assembly further comprises a rear-housing to substantially contain components of said automatic-locking-assembly such that refuse does not contact said automatic-locking-assembly so as to impede proper usage.

15. The automatic locking trashcan system of claim 9, wherein the trashcan-body when normal to said ground surface does not cause said spring to pull said latch arm in compression.

16. The automatic locking trashcan system of claim 11, wherein the trashcan-body when not normal to said ground surface causes said spring to pull said latch arm in compression.

17. An automatic locking trashcan system comprising:
a trashcan assembly comprising;
a trashcan-body having,
an inner volume; and
an outer-surface;
a trashcan-lid; and
an automatic-locking-assembly including,
a spring arm hook;
a latch-arm;
a pivot pin,
a top guide bracket,
a spring bracket,
a spring pin, and
a bottom guide bracket;
a step on pedal; and
a rigid inner liner;
wherein said trashcan assembly comprises said trashcan-body, said trashcan-lid and said automatic-locking-assembly in functional combination such that when said trashcan-body is not normal to a ground surface said automatic-locking-assembly secures said trashcan-lid to said trashcan-body such that trashcan-contents are not able to leave said inner volume;
wherein said trashcan-body is defined by said inner volume and said outer-surface;
wherein the automatic-locking-assembly is located with said inner volume of said trashcan-body;
wherein said trashcan-lid and said trashcan-body are normally in an unlocked-condition when said trashcan-body is normal to said ground surface;
wherein said unlocked-condition permits said trashcan-lid to rotate in relation to said trashcan-body;
wherein a locked-condition does not permit said trashcan-lid to rotate in relation to said trashcan-body;
wherein a spring locks said latch arm in statis when said trashcan-body is not normal to said ground surface;

wherein the coupled communication between said trashcan-lid and said trashcan-body is adjacent each other so long as the trashcan-body is not normal to said ground surface;

wherein a latch-bar is located nearest a rear-inside of said trashcan-lid;

wherein the trashcan assembly further comprises a rear-housing to substantially contain components of said automatic-locking-assembly such that refuse does not contact said automatic-locking-assembly so as to impede proper usage; and wherein said automatic-locking-assembly is able to alternate between said unlocked-condition and said locked-condition dependent on a relative orientation of said trashcan-body to said ground surface.

18. The automatic locking trashcan system of claim 17, further comprising set of instructions; and wherein the automatic locking trashcan system is arranged as a kit.

* * * * *